United States Patent [19]

Bengert

[11] 3,935,946

[45] Feb. 3, 1976

[54] MESH COVERED NESTED DISPLAY CONTAINERS

[76] Inventor: Willis Ray Bengert, 2983 Crescent Road, Pebble Beach, Calif. 93953

[22] Filed: May 18, 1972

[21] Appl. No.: 254,544

[52] U.S. Cl. ..... 206/516; 206/45.33; 215/12 R; 215/99.5

[51] Int. Cl.[2] ..... B65D 21/00; B65D 33/02; B65D 25/24

[58] Field of Search ..... 206/65 K, 45.33, 516; 215/99.5; 220/70

[56] References Cited

UNITED STATES PATENTS

| | | | |
|---|---|---|---|
| 2,206,694 | 7/1940 | Greene | 220/70 UX |
| 2,672,981 | 3/1954 | Colgren | 206/65 K |
| 3,022,605 | 2/1962 | Reynolds | 206/45.33 UX |
| 3,100,487 | 8/1963 | Bathish | 206/65 K UX |
| 3,369,687 | 2/1968 | Walls | 215/99.5 X |
| 3,499,569 | 3/1970 | Wentzel | 215/99.5 |

FOREIGN PATENTS OR APPLICATIONS

| | | | |
|---|---|---|---|
| 392,331 | 5/1933 | United Kingdom | 206/65 K |
| 247,906 | 8/1962 | Australia | 206/45.33 |
| 868,840 | 2/1953 | Germany | 206/45.33 |

*Primary Examiner*—Leonard Summer
*Attorney, Agent, or Firm*—Townsend and Townsend

[57] ABSTRACT

A transparent, vertically disposed, upwardly opening, rigid container including a base, and a protective, elongated, tubular outer envelope of diamond-like mesh, one end of which extends across said base and the sides of which cover the outer surface of the rigid side walls of the container in close, yieldable engagement therewith. A longitudinal extension of said envelope, open at its end, extends over the upper edges of said side walls and into said container to its lower end providing a withdrawable liner.

Said side walls are tapered outwardly in an upward direction for nesting correspondingly mesh-covered containers one within the other, said envelope being inextensible longitudinally thereof and yieldably expandable transversely of its length for expansion of said liner portion to the inner surface of said side walls under the influence of a nested container upon said nesting of one container within the other, said extension being withdrawable for filling said container with the articles to be displayed when said containers are denested and contractible above such articles to provide a carrying handle projecting above said articles, which may be tied closed.

3 Claims, 7 Drawing Figures

MESH COVERED NESTED DISPLAY CONTAINERS

SUMMARY

The use of display containers or packages that contain gifts has heretofore been mainly restricted to baskets, cans and cartons. These have the obvious disadvantage of being opaque thereby restricting the view of the articles. The use of transparent plastic containers has become more popular, as they permit a view of the articles and are attactive. Nestable containers are highly desirable from the standpoint of the supplier of the containers themselves, but heretofore considerable breakage and mutilation by scratches have occurred in shipping nested plastic containers to the maker and distributor or seller of the filled containers, as well as difficulty in denesting the containers.

The cost of material and labor involved in attempting to protect the containers has heretofore been objectionably high, and the protection provided has been uncertain.

Furthermore, heretofore, the assembler finally making up the final display package has had the problem of covering articles such as fruit heaped in a container, and protecting such fruit or articles against unauthorized removal or handling, while providing visibility of the articles from all sides and ventilation, including ventilation.

One of the objects of this invention is the provision of a combination that overcomes the above objections, and which combination is economical to make and results in a more attractive gift package than heretofore.

Another object of the invention is the provision of a rigid, transparent, display container and a flexible envelope therefore that permits full observation of contents of the container when finally filled and closed, and which envelope further provides the protective packing, closure, and carrying handle and is assembled with the container before the latter is filled, but may be removed after the container is emptied to provide a decorative and useful vessel for many purposes.

Other objects and advantages will appear in the description and drawings.

DETAILED DESCRIPTION

Figure 2:
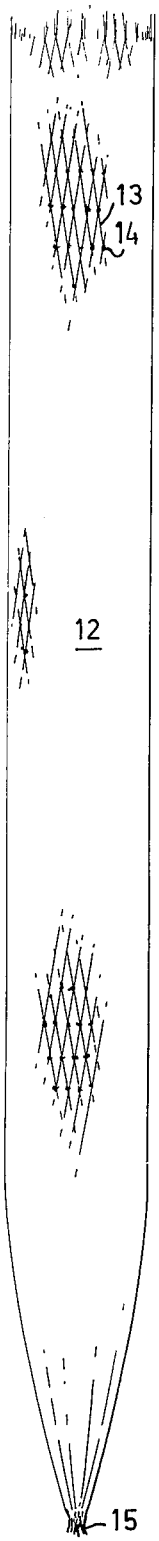
FIG. 2 is a side elevational view of a collapsed, elongated, tubular, flexible envelope of resilient, plastic, diamond-mesh material.

The transparent container illustrated is circular in horizontal cross-sectional contour, having an upper main body portion 1 having generally cylindrical side walls 2, and a bottom wall 3. The side walls taper outwardly in an upward direction. A pedestal or base 4 is adapted to support the body portion 1, said base comprising a central substantially cylindrical hollow, short vertical stem 5 of substantially smaller diameter than the diameter of body 1, and an annular foot 6 coaxial with said stem extends radially outwardly from the lower edges of said stem, the outside diameter of which is approximately that of the outside diameter of the lower end of body 1. The lower end of stem 5 is open providing a central downwardly opening central recess in the pedestal 4.

The annular foot portion 6 is inclined downwardly in direction away from stem 5, and is formed with a plurality of equally spaced downwardly projecting ribs 8, the lower surfaces of which are horizontal and substantially coplanar with the under surface of the foot at its outer edge.

Figure 3:
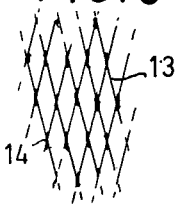
FIG. 3 is a fragmentary, greatly enlarged view of the collapsed mesh material of the envelope of FIG. 2.

The tubular, flexible, resilient, plastic envelope is generally designated 12 and is shown in collapsed position in FIG. 2. This envelope is of diamond-mesh construction known in industry under the name of VEXAR, comprising plastic filaments 13 (FIG. 3) fused together at spaced points at 14 along the lengths of said filaments, and at one end of the tubular envelope the filaments of the envelope are fused together to close the said one end, providing a relatively hard knob 15 at said closed end. The tubular envelope is open at its opposite end.

Figure 1:
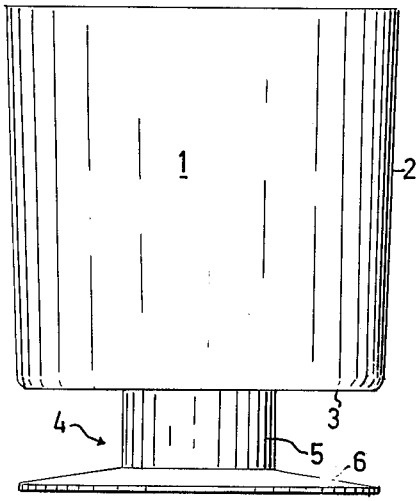
FIG. 1 is a side elevational view of the transparent rigid container.
Figure 4:
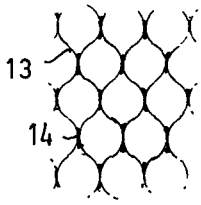
FIG. 4 is a fragmentary greatly enlarged view of the expanded mesh material of the envelope 1.

The envelope is inextensible in a direction longitudinally thereof, but is expandable transversely, as seen in FIG. 4 against the yieldable resistance tending to return it to collapsed position, and it is softer than the plastic of the container of FIG. 1.

The container of FIG. 1 and the envelope 12 are assembled by inserting the container, pedestal end foremost, into the envelope through the open end of the latter. When the base 6 reaches the closed end of the envelope 12, the knob 15 will be centrally below the recess 8 and the mesh will be progressively expanded from said knob to the edges of the foot 6, and will be uniformly expanded to approximately the degree shown in FIG. 4 over the outer surface of the wall 2.

Figure 5:
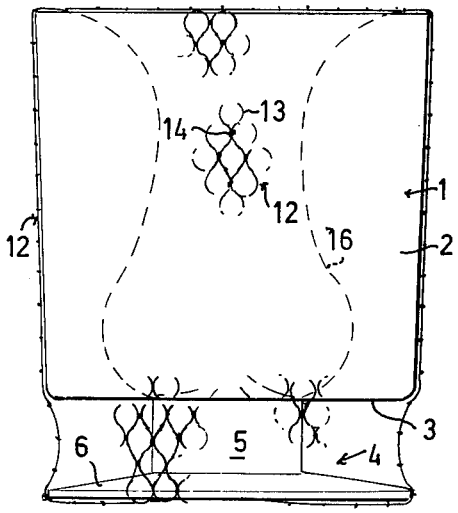
FIG. 5 is a side elevational view of the container of FIG. 1 within the envelope of FIG. 2, with an extension of the envelope extending into the container, indicated in broken lines.

The length of envelope 12 is such that, when enclosing the container, as seen in FIG. 5, an extension 16 is preferably slightly longer than sufficient to extend to the bottom 3 when the extension is positioned within the body 1.

After the container is in the envelope 12 with the lower portion of the latter extending horizontally below the base or foot 6, the extension 16 will be inserted into the body 1 (FIG. 5) and in this position it will be in semi-collapsed form commencing where the envelope extends over the upper edges of body 1, assuming the tubular contour indicated in FIG. 5.

While it is not intended that this invention is limited to specific dimensions, in a container such as shown in FIG. 1 having a body 1 that is approximately 8 inches in diameter and approximately 7 inches in height, with an overall height of approximately 9½ inches, the length of the collapsed envelope of FIG. 2 will be approximately three times said overall height. The lateral expansion of the envelope when enclosing the container substantially reduces its overall length, and as this expansion is against the yieldable resistance of the material, tending to return to collapsed position, the portion of the envelope covering the outer lateral surfaces of the body 1 and the foot 6 are yieldably held against said surfaces in close contact therewith.

Figure 6:
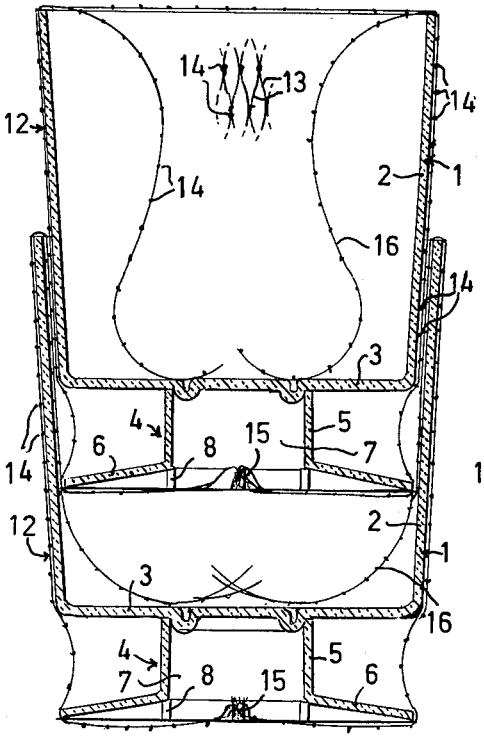
FIG. 6 is a cross-sectional view of a pair of containers, such as shown in FIG. 5, one nested within the other.

The containers assembled in their envelops are nested in any practical number according to the size of the shipping carton, a pair being shown in FIG. 6. When so nested, the extensions 16 become liners and are expanded under the force of the nested container to extend over and be between the inner surface of the body 1 in which it is nested. Thus the liner 16 of one container and the exterior layer of mesh material of the nested container will form a protective layer between the two, as well as insuring against the nested containers sticking together.

The filaments 13 are of thread-like thickness, and the fused points 14 are of slightly greater thickness and much softer than the relatively hard material of the container, therefore there is no scratching of the surfaces that are in engagement with the material of the envelope, and there is sufficient flexibility between the nested containers to prevent development of breaking strains.

Figure 7:
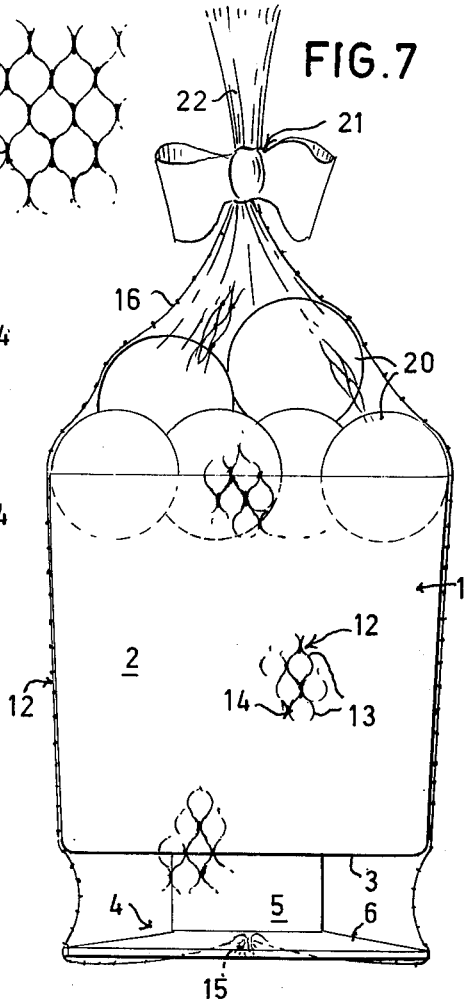
FIG. 7 is a side elevational view of a filled display package in which the extension of the tubular envelope is extended above the contents of the container to extend over the contents and collapsed to provide a carrying handle.

The extension 16 is drawn out of each body 1 when each container is to be filled, and the open end of the envelope can be readily folded back over the outside upper portion of the cylindrical side walls 2 and filled with articles 20 to provide a gift package. In FIG. 7, fruit is indicated, which may be heaped to a height above the upper level of the side walls.

After the container is filled, the extension 16 is drawn together above the contents 20, and tied closed by any suitable means, usually by a decorative tie 21 such as a ribbon, and the portion so drawn together will provide a handle 22 for grasping by the hand of a person to facilitate carrying the package.

As already explained, while the filaments 13 are of thread-like size, they are practically unbreakable under even extraordinary tension and abuse. Each of the mesh openings, when expanded, is over a half inch in diameter, hence the contents of the container can be readily seen from any side. The filled, and enclosed, container will be stable and firm on its foot 6 inasmuch as the knob yieldably moves upwardly to prevent uneven seating of the foot 6. The contents are closed against removal or falling out, and are ventilated and are wrinkle-free up to substantially the point where the tie 21 closes, and substantially to the knob 15, thereby appearing to be integral with the container over the lateral outside surfaces of the latter and with the foot 6 when filled with objects to be displayed. Also no wrinkles are formed in the liner portion between the sides of the nested containers to prevent uniform compact nesting.

I claim:

1. In a display container, the combination comprising:

a. an upright container, nestable with another of corresponding shape and size, having upwardly and outwardly tapered, transparent, lateral side walls, with free terminal upper edges defining the outline of an open upper end and a horizontal bottom wall closing the lower end of said container;

b. an elongated, tubular envelope of open work, flexible, resilient, thread-like mesh material open at one end and closed at its other end resiliently expandable radially thereof from a normally radially contracted untensioned, wrinkle-free condition substantially less than the diameter of said container, to an expanded, raidally tensioned, wrinkle-free condition at least equal to the maximum outside diameter of said container;

c. said envelope enclosing said container with its closed end extending horizontally below said bottom wall and the remaining portions thereof, in succession from said closed end of said envelope, extending in said radially evenly expanded, tensioned, condition over and yieldably against the outer surface of said lateral side walls and said upper free edges, and then downwardly into said container in a progressively contracted, but yieldably radially expandable, condition with said open end of said envelope terminating adjacent the bottom of said container, whereby said portion extending downwardly into said container will be radially expandable under the influence of another container of corresponding shape and size being nested within a container enclosed by said envelope.

2. The combination as defined in claim 1:

d. said tubular enclosure being approximately double the height of said container, and said portion thereof extending into said container in said retracted, untensioned condition being withdrawable to a progressively retracted condition in upward longitudinal extension of the expanded portion that is in yieldable engagement with the outer surface of said container, thereby providing an open-work portion adapted to extend over produce that may fill said container when said container is free for such withdrawal.

3. The combination as defined claim 1, including;

d. a second container nested within the container enclosed by said envelope; and e. said contracted portion of said envelope within the container enclosed by said envelope heing radially 16 expanded to wrinkle-free condition under tension against said second container.

* * * * *